United States Patent [19]

Wilks

[11] 4,167,723

[45] Sep. 11, 1979

[54] ELECTRIC FUSE HAVING GAS-EVOLVING MATERIAL

[75] Inventor: Howard G. Wilks, Newbury, Mass.

[73] Assignee: Gould Inc., Rolling Meadows, Ill.

[21] Appl. No.: 867,964

[22] Filed: Jan. 9, 1978

[51] Int. Cl.[2] ..... H01H 85/38

[52] U.S. Cl. ..... 337/273; 337/161

[58] Field of Search ..... 337/273, 158, 161, 276, 337/278, 279, 280, 281, 293, 162; 200/149 A, 150 D, 151

[56] References Cited

U.S. PATENT DOCUMENTS 2,142,840 4/1938 Grosse ..... 200/149 A

FOREIGN PATENT DOCUMENTS 14677 10/1933 Australia ..... 337/162

*Primary Examiner*—Harold Broome

*Attorney, Agent, or Firm*—Erwin Salzer

[57] ABSTRACT

An electric fuse having a gas evolving substance to generate arc-quenching blasts of gas when arcing inside the fuse occurs. Fuses of this type are known. However, fuses according to present fuses are far simpler to manufacture than prior art fuses of this description. They comprise a block of gas evolving material shorter than the diameter of the casing of the fuse arranged substantially transversely to and between a pair of fusible elements, the pair of fusible elements hugging a portion of the periphery of the block so as to position the block loosely at a predetermined point between the terminal elements.

4 Claims, 8 Drawing Figures

ELECTRIC FUSE HAVING GAS-EVOLVING MATERIAL

BACKGROUND OF THE INVENTION

Gas evolving materials are widely used for producing arc extinguishing blasts. Thus U.S. Pat. No. 3,949,342 to Frederick J. Kozacka, Apr. 6, 1976, ELECTRIC FUSE FOR ELEVATED CIRCUIT VOLTAGES, describes the use of beads producing opposite pairs of arc-extinguishing blasts. The beads are, however, relatively expensive to manufacture and do not lend themselves well to applications in connection with relatively wide ribbon-type links as distinguished from relatively narrow wire-type fusible elements.

U.S. Pat. No. 3,766,509 to Frank L. Cameron, HIGH VOLTAGE CURRENT LIMITING FUSE, Oct 16, 1973 gives a brief history of prior art devices capable of producing arc-quenching blasts, and claims one specific device supposed to be better than the prior art devices. But this device is also relatively expensive to manufacture.

U.S. Pat. No. 3,935,553 to Frederick J. Kozacka et al, Jan. 27, 1976 for CARTRIDGE FUSE FOR D.C. CIRCUITS discloses a gas-evolving structure limited to time-lag fuses having wide ribbon links.

The present invention relates to electric fuses having a gas-evolving substance which fuses are not subject to the limitations of prior art fuses of that description.

SUMMARY OF THE INVENTION

Electric fuses embodying the present invention comprise a tubular casing of electric insulating material, a pulverulent arc-quenching filler inside said casing, terminal elements closing the ends of said casing, and at least a pair of opposed, parallel extending fusible elements embedded in said arc-quenching filler and conductively interconnecting said terminal elements. A block of gas-evolving material of shorter length than the diameter of said casing is arranged substantially transversely to a pair of and between said pair of fusible elements. Said pair of fusible elements hug a portion of the periphery of said block so as to position said block loosely at a predetermined point between said terminal elements.

DESCRIPTION OF PREFERRED EMBODIMENTS

Figure 1:
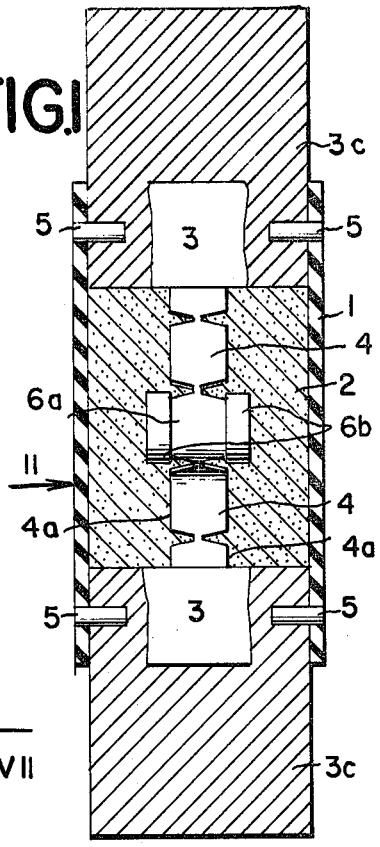
FIG. 1 is principally a longitudinal section of an electric fuse embodying the instant invention, as seen in the direction of the arrow I in FIG. 2, some of the parts of the fuse being shown in elevation rather than sectionalized.
Figure 2:
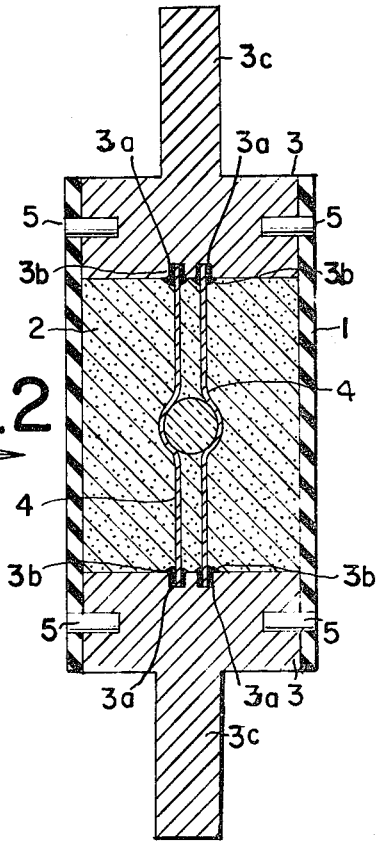
FIG. 2 is principally a longitudinal section of the electric fuse of FIG. 1, as seen in the direction of arrow II of FIG. 1.

Referring now to the drawings, and more particularly to FIGS. 1 and 2 thereof, numeral 1 has been applied to indicate a tubular casing of electric insulating material, e.g. a glass-cloth-melamine-laminate, which is filled with a pulverulent arc-quenching filler 2, e.g. quartz sand. The terminal elements of the fuse include terminal plugs 3 and blade contacts 3*c* projecting axially outwardly from terminal plugs 3. The axially inner end surfaces of terminal plugs 3 are provided with straight grooves 3*a*, not shown in FIG. 1 but clearly shown in FIG. 2. The ends of a pair of fusible ribbon elements 4 are arranged in grooves 3*a* and conductively connected to terminal plugs 3 by soft solder joints 3*b*. Casing 1 is pinned by steel pins 5 to terminal plugs 3.

A block 6*a*,6*b* of a material evolving gases under the heat of an arc, more particularly arc-quenching gases, is arranged between the pair of opposed parallel extending fusible ribbon elements 4. The block may, for instance, consist of mixtures of melamine resins and appropriate metal oxides. That block comprises a cylindrical center portion 6*a* and two axially outer end portions 6*b* having a slightly larger diameter than center portion 6*a*. Block 6*a*,6*b* is arranged substantially symmetrically to and in the gap between the pair of fusible elements 4 and its length is less than the inner diameter of casing 1. Fusible elements 4 hug, or engage, a portion of the periphery of block 6*a*,6*b* so as to position said block relatively loosely at a predetermined point between fusible elements 4.

Block 6*a*,6*b* has a relatively small periphery at the area 6*a* thereof hugged by fusible ribbon elements 4 and a relatively large periphery at the ends thereof projecting beyond the longitudinal edges 4*a* of elements 4. This configuration prevents substantially a movement of block 6*a*,6*b* in a direction longitudinally thereof in the absence of any fastener means for securing block 6*a*,6*b* to fusible elements 4.

Figure 4:
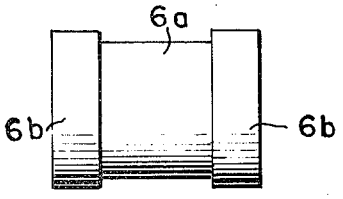
FIG. 4 is a side elevation of the structure of FIG. 3.
Figure 3:
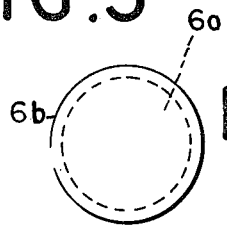
FIG. 3 shows on a larger scale than FIGS. 1-2 an end view of the gas-evolving body of FIGS. 1-2.

As shown in FIGS. 3 and 4 the periphery of center portion 6*a* is circular in cross-section and so are its pair of flange portion 6*b*. This is the preferred embodiment of the invention. The edges of elements 4 abut against the flanges of block 6*a*,6*b* and this prevents substantially any movement of block 6*a*,6*b* in a direction longitudinally thereof. It will be apparent from FIG. 2 that the fusible ribbon elements hug block 6*a*,6*b* at a portion thereof where its periphery is relatively small, but does not hug all of said relatively small portion but departs at two spaced points from the periphery of block 6*a*,6*b*. A single block of gas evolving material is needed for deionizing the path of two parallel arcs of which one is formed by fusion of one of the elements 4 and the other by fusion of the other element 4.

Figure 6:
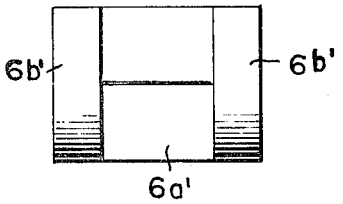
FIG. 6 is a side elevation of the structure of FIG. 5.
Figure 5:
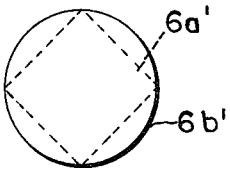
FIG. 5 shows on a larger scale than FIGS. 1 and 2 a modification of the structure of FIGS. 3 and 4.

The gas-evolving substance does not necessarily have cylindrical shape. As shown in FIGS. 5 and 6 the gas-evolving substance has a central core 6*a*′ which is square in cross-section and it has two axially outer flanges 6*b*′ which are circular in cross-section. The configuration of substance 6*a*,6*b* shown in FIGS. 3 and 4 is cheaper to manufacture than that shown in FIGS. 5 and 6 and represents, therefore, the preferred embodiment of the invention.

Figure 7:
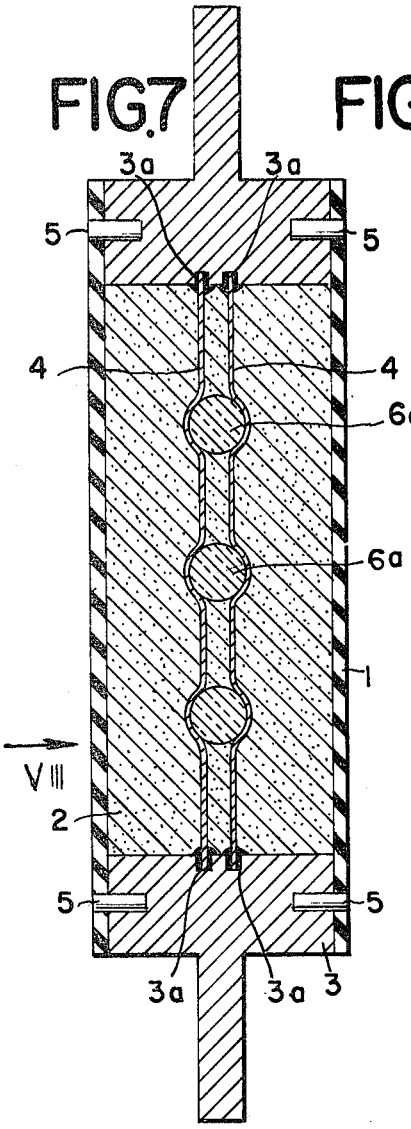
FIG. 7 is principally a longitudinal section of a series break fuse embodying the present invention as seen in the direction of the arrow VII of FIG. 8, some of the parts of the fuse being shown in elevation rather than sectionalized.
Figure 8:
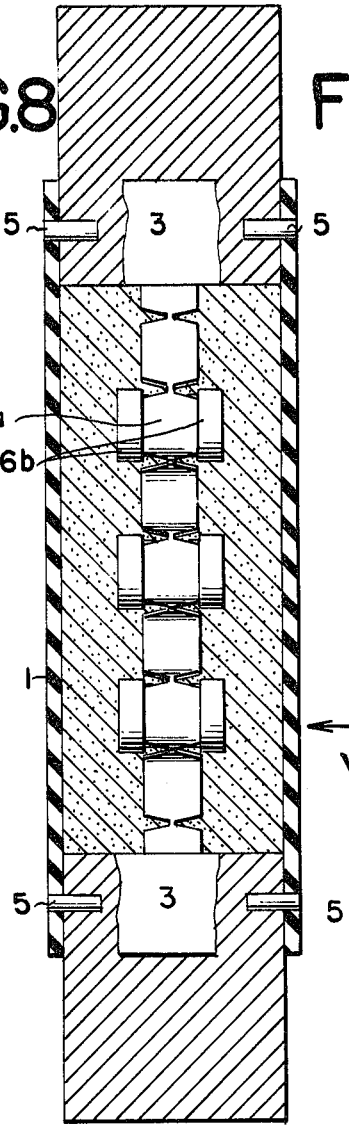
FIG. 8 is principally an elevation and partly a section of the fuse shown in FIG. 7 as seen in the direction of arrow VIII of FIG. 7.

The structure of FIGS. 7 and 8 differs from that of FIGS. 1 and 2 only in that the first mentioned figures refer to a multibreak fuse and the latter to a single break fuse. The description of FIGS. 7 and 8 may be held brief since in all figures corresponding parts have been indicated by the same reference numerals. As shown in FIGS. 7 and 8, each plug terminal 3 is pinned by steel pins 5 to fuse housing 1 of electric insulating material. Plug terminals 3 are conductively interconnected by a pair of fusible elements 4 embedded in the pulverulent arc-quenching filler 2. Each fusible element 4 is equidistant to the other fusible element 4, except for three points when the spacing between the fusible elements is increased. At each of these three points a body *6a,6b* of a substance evolving a gas under heat of an electric arc is inserted into the gap formed between fusible elements 4 and held in position by them. The body *6a,6b* has the same geometry as that shown on a larger scale in FIGS. 3 and 4. The ends of fusible elements 4 are inserted into grooves *3a* in terminal plugs 3 and conductively connected by joints of soft solder to terminal plugs 3.

The gas evolving element shown may be used in back-up fuses as well as in fuses capable of interrupting a wide range of currents. In the first mentioned case the maximal gas-pressure generated by elements *6a,6b* must be equal to the short-time or dynamic pressure rating of casing 1. In the last mentioned case the maximum gas-pressure generated by elements *6a,6b* must be equal to the pressure to which casing 1 is exposed on the interruption of small currents which is a process involving a relatively long period of time.

I claim as my invention:

1. An electric fuse having a gas-evolving substance to generate arc-extinguishing blasts of gas comprising a tubular casing of electric insulating materials, a pulverulent arc quenching filler inside said casing, terminal elements closing the ends of said casing, and at least two opposed, parallel extending fusible elements embedded in said arc-quenching filler and conductively interconnecting said terminal elements wherein the novelty consists of a block of gas-evolving material of shorter length than the diameter of said casing arranged substantially transversely to, and between, a pair of fusible elements, said block has a relatively small periphery which is hugged by said pair of fusible elements and has a relatively large periphery at the ends thereof projecting beyond the longitudinal edges of said fusible elements so that said edges substantially prevent movement of said block in a direction longitudinally thereof.

2. A fuse as specified in claim 1 wherein the cross-section of said block is circular and said fusible elements hug the preponderant portion of the periphery of said block but are spaced from each other at a point remote from the periphery of said block.

3. A fuse as specified in claim 1 including a plurality of blocks of gas-evolving material arranged at different positions of said fusible elements.

4. A fuse as specified in claim 1 wherein said gas-evolving element has a peripheral groove midway between the ends thereof substantially equal in width to the width of said pair of fusible elements, said pair of fusible elements engaging said groove to limit relative movement of said gas-evolving element and said pair of fusible elements.

* * * * *